United States Patent [19]

Woody

[11] 3,933,949

[45] Jan. 20, 1976

[54] CHARGE FORMING APPARATUS

[75] Inventor: John C. Woody, Toledo, Ohio

[73] Assignee: Borg-Warner Corporation, Chicago, Ill.

[22] Filed: May 3, 1974

[21] Appl. No.: 466,605

[52] U.S. Cl. ..... 261/35; 261/41 D; 261/DIG. 68

[51] Int. Cl.[2] ..... F02M 17/04

[58] Field of Search..... 261/DIG. 68, 41 D, 35, 261/66

[56] References Cited

UNITED STATES PATENTS

| | | | |
|---|---|---|---|
| 2,215,683 | 9/1940 | Wirth | 261/41 D |
| 2,852,240 | 9/1958 | Goodyear | 261/41 D |
| 3,003,754 | 10/1961 | Phillips | 261/DIG. 68 |
| 3,281,128 | 10/1966 | Phillips | 261/DIG. 68 |
| 3,320,937 | 5/1967 | Meininger | 261/DIG. 68 |
| 3,441,010 | 4/1969 | Barr et al. | 261/DIG. 68 |
| 3,453,994 | 7/1969 | Nutten et al. | 261/DIG. 68 |
| 3,633,557 | 1/1972 | Tuckey et al. | 261/DIG. 68 |
| 3,743,254 | 7/1973 | Tuckey | 261/DIG. 68 |

*Primary Examiner*—Tim R. Miles
*Attorney, Agent, or Firm*—Harry O. Ernsberger

[57] ABSTRACT

The disclosure embraces a charge forming apparatus or carburetor and method of operation thereof wherein the charge forming apparatus is of modular construction comprising a body construction and a fluid flow control system including a laminar means or member having perforate fuel conveying regions including a channel for conveying fuel from a fuel chamber to an engine idling and low speed orifice system in association with a passage arranged to receive pressure pulses from the engine crankcase under open throttle conditions for discharging fuel in the channel through an aperture means independent of the main and engine idling fuel delivery aperture means into the air induction system of the charge forming apparatus for engine acceleration purposes, the fuel conveying channel being of substantial length and of a cross sectional area to effect delayed fuel flow to the engine idling system to avoid formation of an overrich mixture which would result in stalling the engine.

9 Claims, 19 Drawing Figures

CHARGE FORMING APPARATUS

The invention embraces a charge forming apparatus of modular construction embodying a laminate or fuel flow control member fashioned with perforate regions arranged to convey fuel into an air induction zone of the charge forming apparatus for normal and high speed engine operation and for engine idling and low speed operation, the charge forming apparatus including an independent aperture means opening into the air induction zone for delivering fuel for engine accelerating purposes under the influence of pressure pulses from the crankcase of a two cycle engine.

The invention has for an object the provision of a charge forming apparatus or carburetor having a fuel and air mixing passage, main fuel delivery aperture means for delivering fuel into the mixing passage for normal and high speed engine operation, aperture means for delivering fuel into the mixing passage for engine idling and low speed operation, and additional aperture means opening into the mixing passage for delivering fuel into the mixing passage for engine acceleration purposes.

An object of the invention is the provision of a charge forming apparatus or carburetor having a fuel and air mixing passage and main and supplemental fuel delivery aperture means or orifices, the arrangement including a fuel flow system for delivering fuel through additional aperture means or orifice for engine acceleration wherein the fuel for engine acceleration is projected through the additional aperture means or orifice by engine crankcase pressures controlled by valving associated with or brought into operation during movement of the throttle valve toward open or high speed position.

Another object of the invention resides in the provision of an aspirated type of diaphragm carburetor having a fuel channel system effective upon opening of the throttle valve whereby fuel is aspirated through a main orifice means into the mixing passage and additional fuel delivered into the mixing passage for engine accelerating purposes through an orifice means independently of the delivery of fuel through the main orifice means and engine idling orifice means.

Another object of the invention is the provision of a charge forming apparatus or carburetor comprising a body construction having two components with a laminate or member associated with the body components having a perforation or channel for conveying fuel in one direction from a fuel chamber to the engine idling aperture means or orifice, and upon opening of the throttle in the mixing passage to convey fuel in the opposite direction to an orifice or aperture means opening into the mixing passage and independent of the main and engine idling aperture means or orifices.

Another object of the invention is the provision of a carburetor of the aspirated diaphragm type having a fuel and air mixing passage and main fuel delivery and engine idling aperture means, the carburetor embodying a fuel channel adapted to be filled with fuel from a fuel chamber and the fuel delivered into the mixing passage through engine idling aperture means for engine idling operation, and when the throttle valve is opened the fuel in the fuel channel is scavenged from the fuel channel and delivered into the mixing passage independently of fuel delivered through the main aperture means to promote acceleration of the engine.

When the throttle valve is moved to engine idling position, the fuel channel is replenished with fuel from the fuel chamber, the fuel channel being of a configuration and size requiring a period of time to be filled with fuel so as to delay delivery of fuel through the engine idling aperture means and thereby avoid an overrich mixture which would tend to cause stalling of the engine.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 3:
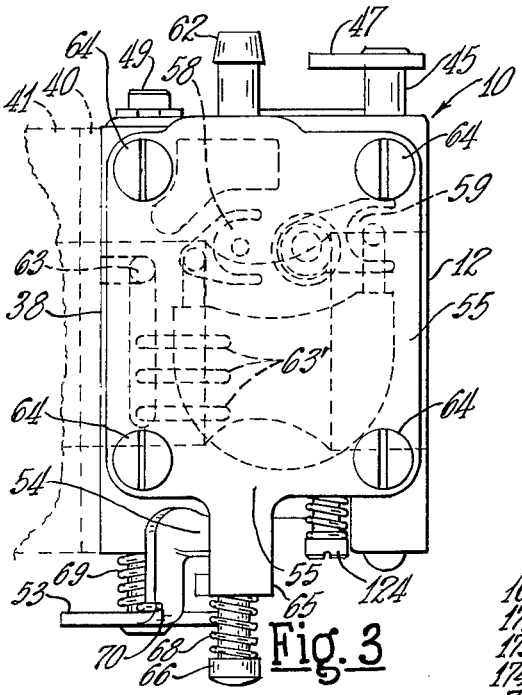
FIG. 3 is a top plan view of the carburetor and fuel pump construction.

The carburetor construction embodying the fluid flow control system of the invention is preferably of a character particularly usable with an internal combustion engine of the two-cycle or two-stroke type, the carburetor embodying as aspirated diaphragm for regulating fuel flow from a supply to the fluid flow control system, the pressure pulsations from the engine crankcase or other pressure source being employed for pumping fuel from a supply to the carburetor and for flowing fuel through the flow control system for engine accelerating purposes.

Referring to the drawings in detail and initially to FIGS. 1 through 8, the charge forming apparatus or carburetor 10, which is of the aspirated diaphragm type, is inclusive of a body construction comprising a first body member or main body 12 and a second body member or supplemental body 14. The body components or body members 12 and 14 are preferably fashioned as die castings of metal, but it is to be understood that the bodies may be formed of substantially rigid plastic or other suitable material.

Figure 16:
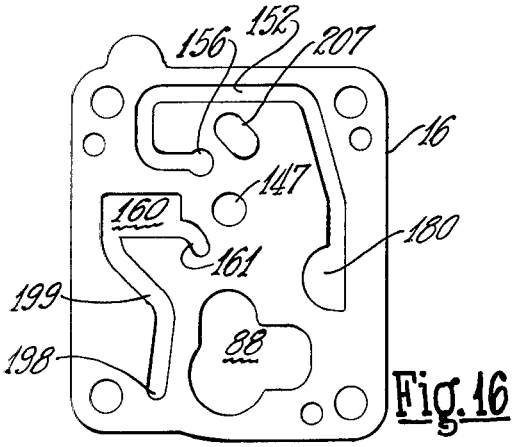
FIG. 16 is a plan view illustrating a form of fluid flow control member or laminate showing a pattern of open areas or passages accommodating fluid flow.

Associated with or disposed between the body members 12 and 14 is a fluid flow control means including a laminar means or member, laminate or plate 16, shown in detail in FIG. 16. The laminate or plate 16 is fashioned with perforate regions, channels or passages hereinafter described for conveying, accommodating and controlling flow of fluids, such as liquid fuel, air, or a mixture of fuel and air.

The plate or member 16 is fashioned of a material resistant to deterioration by hydrocarbon fuels, such as fibrous or other gasket material, semihard synthetic rubber, resinous plastic material, such as Mylar (a condensation reaction product of terephthalic acid and ethylene glycol), Teflon (polytetrafluoroethylene) or suitable metals, such as copper, brass, aluminum or stainless steel.

Disposed between the plate or laminate 16 and the body member 14 is a comparatively thin member or gasket 18 fashioned with a flap valve, shown in detail in FIG. 16. The gasket or member 18 is fashioned of flexible or resilient resinous plastic, such as Teflon (polytetrafluoroethylene), Kel-F (polytrifluorochloroethylene) or similar material. The resinous body or gasket 18 may be reinforced with glass fibers or other fibers.

The main body or member 12 of the carburetor 10 is fashioned with a fuel and air mixing passage 20, the passage including an air inlet region or induction zone 22 defined by a cylindrical wall 23, a mixture outlet region 24 defined by a cylindrical wall 25, a member 26 providing a Venturi or Venturi configuration 27 having a choke band region 28 or region of minimum diameter and a fuel dispersion zone.

Figure 4:
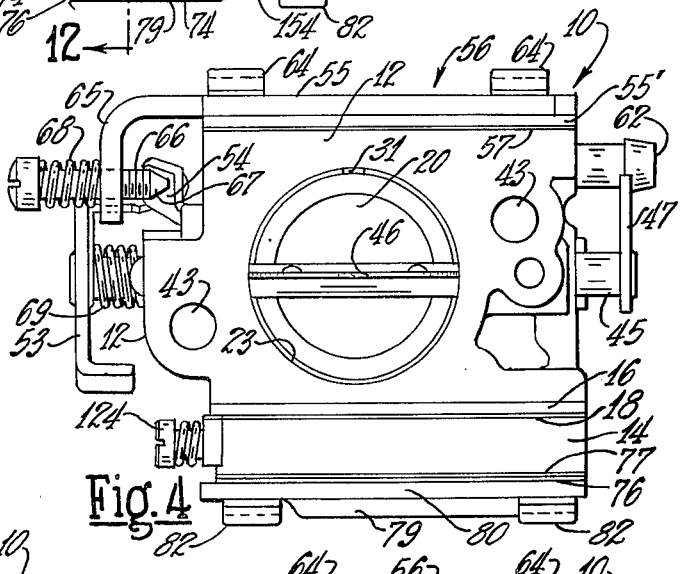
FIG. 4 is an elevational view of the air inlet end of the construction shown in FIG. 1.
Figure 5:
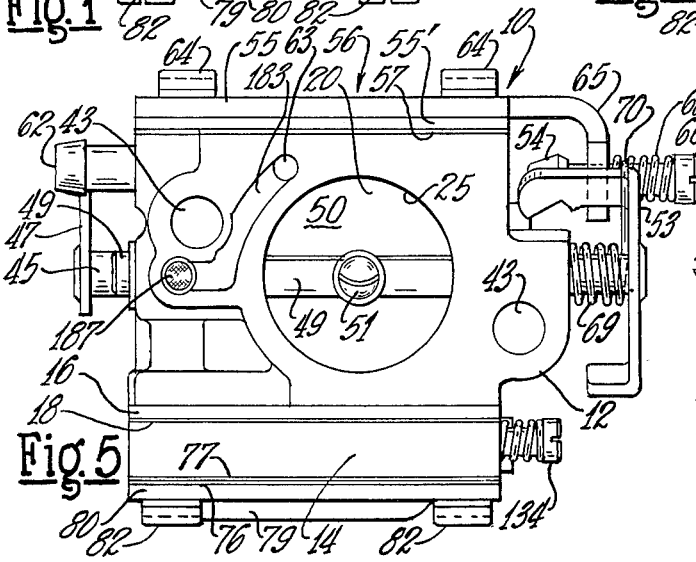
FIG. 5 is an elevational view of the mixture outlet end of the construction shown in FIG. 1.
Figure 2:
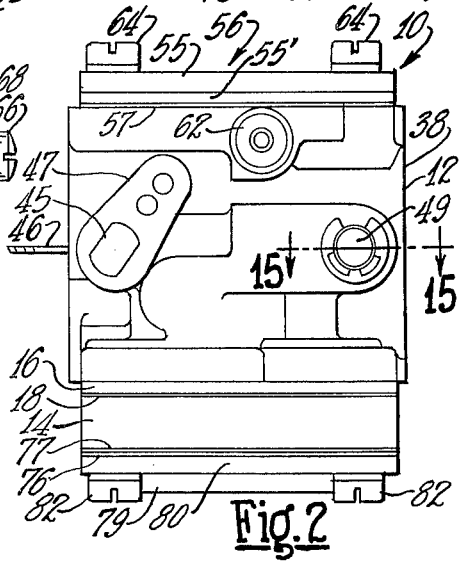
FIG. 2 is an elevational view of the opposite side of the construction illustrated in FIG. 1.
Figure 8:
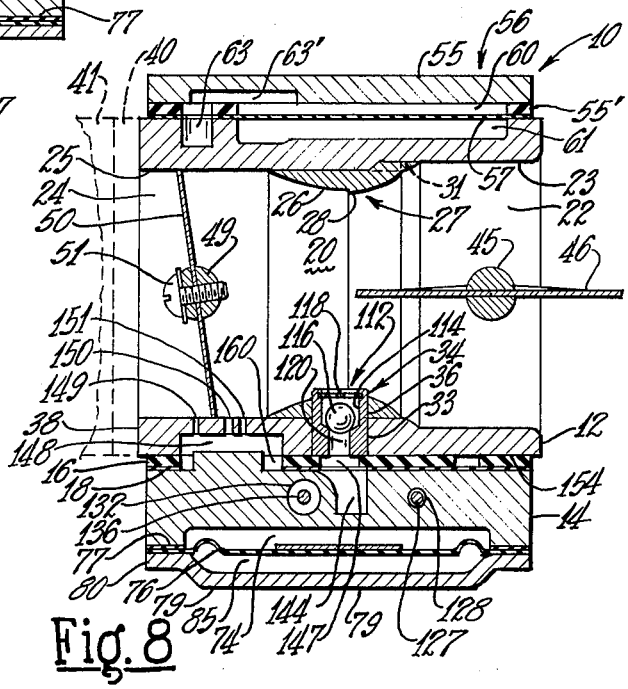
FIG. 8 is a longitudinal sectional view taken substantially on the line 8—8 of FIG. 6.

The Venturi member 26 is removable so that a similar member having a different size or configuration of Venturi may be utilized for changing or varying the flow capacity of the mixing passage to enable the use of the carburetor with engines of different size or horsepower. As shown in FIGS. 4 and 8, the member 26 is held against relative rotation by a lug or key 31 on the member which is received in a short slot provided in the cylindrical surface 25.

A wall region of the body or member 12 is fashioned with a bore 33 into which is press-fitted a cylindrical member or fitting 34 which provides an aperture means or main orifice construction hereinafter described. The fitting 34 extends into a transverse bore 36 formed in the Venturi member 26. The inter-engagement of the key 31 in the slot in the cylindrical surface 25 effects alignment of the bores 33 and 36 to properly accommodate the fitting 34.

The mixture outlet end of the carburetor body 12 is fashioned with a uniplanar surface 38 adapted to engage a heat insulating gasket 40, shown in broken lines in FIGS. 3, 8, 14 and 15. The gasket 40 is adapted to engage a boss portion 41 on a crankcase of a two-cycle engine or a similar boss portion on an engine cylinder of a two-cycle engine of the three-port type. Where the carburetor is utilized with a reed valve type of two-cycle engine, a conventional reed valve construction (not shown) may be disposed between the gasket 40 and the boss portion 41. The mixture outlet 24 of the mixing passage registers with openings in the gasket 40 and the boss portion 41 for delivering fuel and air mixture to the engine.

The air inlet end of the body 12 may be fitted with an air filter or air cleaner (not shown) of conventional construction. The body member 12 is fashioned with bores 43 extending through the body accommodating bolts or studs (not shown) for securing the carburetor and heat insulating gasket 40 in assembly with the boss 41 on the engine crankcase or cylinder wall.

Extending across the air inlet region 22 and journaled in bores provided in the body 12 is a rotatable shaft 45 mounting a conventional choke valve 46. Secured upon an end of the shaft 45 projecting beyond the body 12 is a manipulating arm 47 for opening and closing the choke valve 46. Journaled in bores in the body 12 adjacent the mixture outlet region 24 is a rotatable throttle shaft 49 mounting a disctype throttle valve 50 secured to the shaft by a screw 51.

A portion of the throttle shaft 49 extending exteriorly of the body 12 has a noncircular portion 52 on which is pressfitted a manipulating member 53, the member having a projection 54, shown in FIGS. 1, 3, 4 and 5. A plate or member 55 forming a component of a diaphragm-type fuel pump construction 56 is secured to the upper region of the carburetor by means of securing screws 64. The plate 55 is fashioned with a projection 65 having a threaded opening accommodating an engine idling adjusting screw 66, the tapered end portion 67 of the adjusting screw being engaged by the projection 54 on the member 53 secured to the throttle shaft 49.

The screw 66 is adjustable for regulating the engine idling position of the throttle valve 50. An expansive coil spring 68 provdes friction for holding the screw 66 in adjusted position. Surrounding the throttle shaft 49 adjacent the member 53 is a coil spring 69 having one end 70 engaging the member 53 for normally biasing the throttle valve 50 toward engine idling position. The member 53 is fashioned with several openings 71 to selectively accommodate a rod (not shown) for actuating the throttle valve 50.

Figure 7:
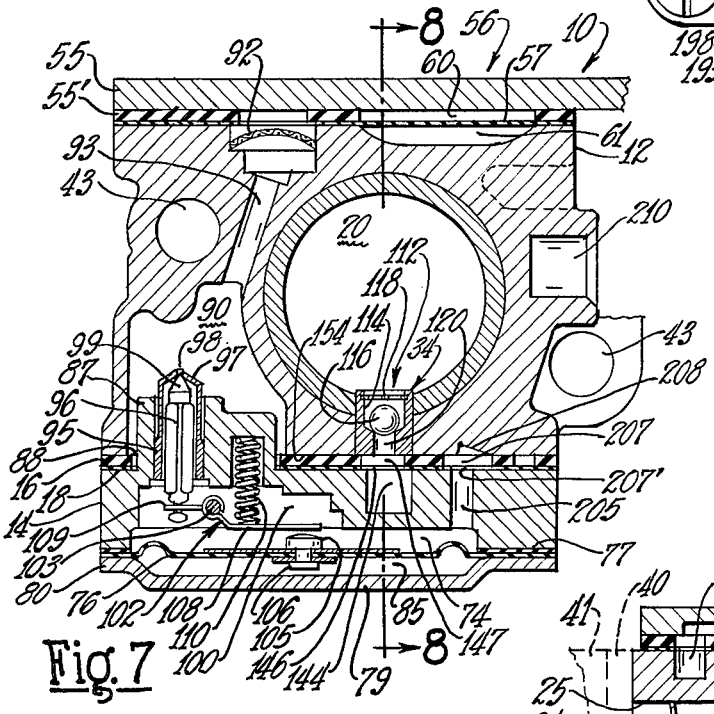
FIG. 7 is a transverse sectional view through the carburetor construction, the view being taken substantially on the line 7—7 of FIG. 6.

The body member or component 14 is formed with a generally circular shallow recess providing a fuel chamber 74, particularly shown in FIGS. 7 and 8, containing liquid fuel. A flexible membrane or diaphragm 76 extends across the recess and forms a wall of the fuel chamber 74. A sealing gasket 77 is disposed between the peripheral region of the diaphragm 76 and the body 14. A cover member 79 is disposed beneath the diaphragm 76, the peripheral region 80 of the cover member 79 engaging the peripheral region of the diaphragm 76.

The laminate or plate 16, the gasket or laminate 18, the body 14, the gasket 77, the peripheral region of the diaphragm 76 and the peripheral region 80 of the cover 79 are provided with registering openings accommodating securing screws 82 which are engaged in threaded openings in the carburetor body or member 12 to secure these elements or members in assembled relation. The cover member 79, as shown in FIGS. 7 and 8, is configurated with a depressed central region to accommodate flexing movements of the diaphragm 76. The cover member 79 has an opening 84 to vent the space or chamber 85 at the dry side of the diaphragm to the atmosphere.

The diaphragm 76 is adapted to be actuated or flexed by aspiration or reduced pressure established in the mixing passage 20 by engine operation, the relative position of the diaphragm regulating the flow or delivery of liquid into the fuel chamber 74. The fuel chamber 74 is unvented except through the fuel flow channels or passages establishing communication between the fuel chamber 74 and the mixing passage 20.

Figure 6:
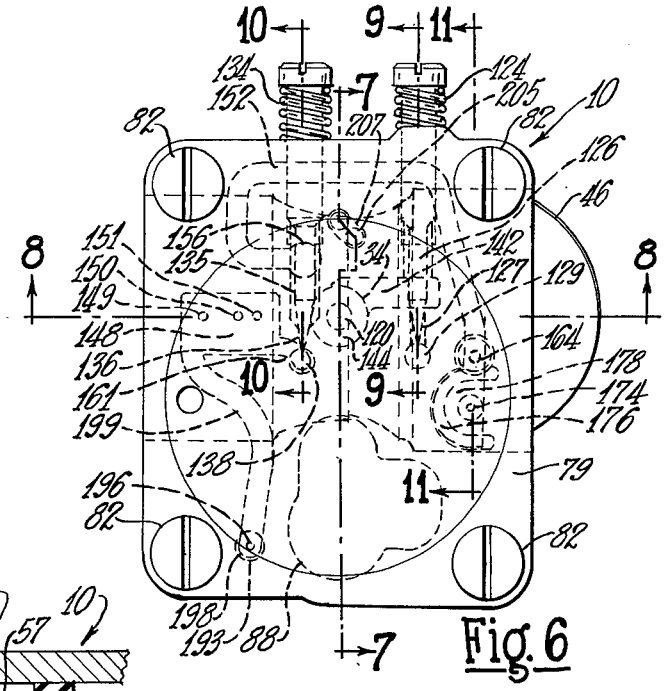
FIG. 6 is a bottom plan view of the carburetor construction.

The body member or component 14 is provided with an upwardly extending portion 87, shown in FIG. 7, the plate or laminate member 16 having an opening 88, shown in FIGS. 6, 7 and 16, accommodating the portion 87. The body member or component 12 is fashioned with a recess or chamber 90, shown in FIG. 7, which accommodates liquid fuel delivered from the diaphragm fuel pump construction 56.

The fuel pump 56 includes fuel inlet and outlet ports provided in the body member 12 and a pumping diaphragm 57 having integral flap valves 58 and 59 cooperating with the inlet and outlet ports. The pumping diaphragm 57 extends across a cavity providing a pulse chamber 60 in a laminate member or gasket 55' and a fuel chamber 61 in the body member 12, the fuel chamber receiving fuel through a fitting or nipple 62 and a flexible tube (not shown) connected with a fuel tank or fuel supply. The pulse or pumping chamber 60 is connected by a pulse passage 63 and passages 63' with the engine crankcase whereby pressure pulsations in the engine crankcase cause flexing or pumping movements of the pumping diaphragm 57. The fuel pump construction forms no part of the present invention.

Fuel from the fuel pump 56 flows through a filter screen 92 and a passage 93 into the chamber 90. The chamber 90 serves as a surge chamber for absorbing or dissipating energy of momentum of the fuel delivered from the fuel pump to promote smooth flow of fuel into the chamber 90. As shown in FIG. 7, the upwardly extending portion 87 of the body member 14 is provided with a bore in which is pressed or snugly fitted a tubular member or sleeve 95, the sleeve providing a valve cage or guide means slidably accommodating an inlet valve or valve body 96.

The upper end of the valve guide or sleeve 95 is conically shaped as at 97, the apex portion being provided with a fuel inlet port or passage 98. The valve member or body 96 may be fashioned of metal or resinous material and is of conventional polygonally-shaped cross section facilitating flow of liquid fuel from the chamber 90 along the valve member into the diaphragm fuel chamber 74. The valve body 96 is provided with a cone-shaped valve or valve portion 99 for controlling or regulating fuel flow through the port 98.

Means is provided for transmitting flexing movements of the diaphragm 76 to the inlet valve body 96 for regulating fuel flow into the fuel chamber 74, the diaphragm being responsive to aspiration in the mixing passage. The body member 14 is configurated with a recess 100 forming a portion of the fuel chamber 74. The recess 100 accommodates a lever 102 fulcrumed intermediate its ends on a fulcrum pin 103 mounted by the body member 14.

The central region of the diaphragm 76 is equipped with a headed member 105 which has a tenon portion extending through registering openings in the diaphragm and reinforcing discs disposed at each side of the diaphragm, the member being swaged as at 106 to secure the diaphragm and reinforcing discs in assembled relation. The long arm 108 of the lever 102 is arranged to be engaged by the headed member 105. The short arm 109 of the lever is articulately connected with the lower end region of the inlet valve body 96.

The articulate connection comprises a bifurcated end portion on the short arm of the lever engaging in an annular recess provided in the valve body whereby swinging movements of the lever 102 control the relative position of the inlet valve 96. An expansive coil spring 110 engages the long arm 108 of the lever 102, the spring exerting a biasing force normally urging the inlet valve 96 to port-closing position.

Aspiration established in the mixing passage 20 effects flexing movements of the diaphragm 76 through fuel passages and channels as hereinafter described, the aspiration or reduced pressure flexing the diaphragm 76 upwardly as viewed in FIG. 7 whereby the headed member 105 swings the lever 102 in a counterclockwise direction to withdraw the inlet valve portion 99 from the port 98 to valve in fuel from the chamber 90 into the diaphragm fuel chamber 74.

A fuel dispersion zone is provided for the mixing passage which is inclusive of a main or primary fuel delivery aperture means or orifice for discharging fuel for intermediate and high speed engine operation, a secondary or supplemental fuel delivery aperture means including supplementary fuel discharge orifices for engine idling and low speed operation, and an additional aperture means or orifice for delivering fuel into the mixing passage for engine accelerating purposes.

Figure 18:
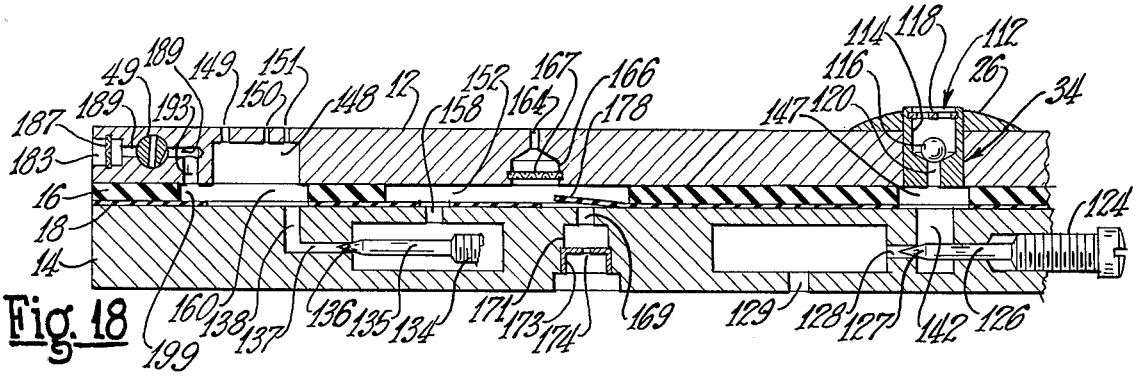
FIG. 18 is a semischematic sectional view illustrating air and fuel flow paths in passages in the body construction and in the fluid flow control means and the fuel regulating valve means.

The main or primary fuel delivery aperture means or system comprises a main orifice or aperture means 112 which is the outlet of a counterbore 114 provided in the fitting 34, shown in FIGS. 7, 8 and 18. The counterbore 114 accommodates a check valve means such as a ball valve 116 loosely disposed in the counterbore which is prevented from dislodgment by a grid 118 extending across the outlet providing the main orifice 112. The ball valve 116 is adapted to seat against a ledge at the end of a bore or passage 120 in the fitting 34 when the engine idling system is delivering fuel into the mixing passage to prevent back bleeding of air into the fuel chamber 74.

Figure 9:
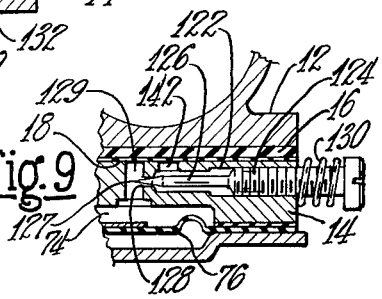
FIG. 9 is a detailed sectional view taken substantially on the line 9—9 of FIG. 6 illustrating the high speed fuel adjusting valve.

Referring particularly to FIG. 9, the body member 14 is provided with a bore 122 having a threaded region accommodating the threaded portion of a valve means or valve 124, the latter constituting a high speed fuel adjusting valve member or restrictor. The valve 124 has a tenon portion 126 terminating in a needle valve portion 127 cooperating with a restricted passage 128 in communication with a fuel passage or channel 129 which opens into and receives fuel from the fuel chamber 74. A coil spring 130 is associated with the valve or valve body 124 providing friction for holding the valve body and needle valve portion 127 in adjusted position.

Figure 10:
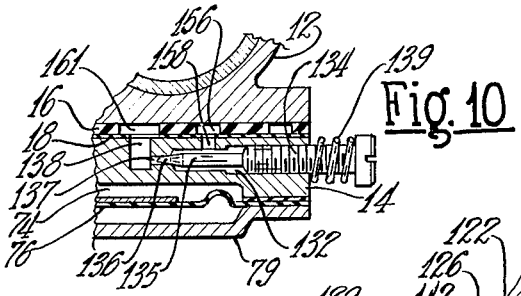
FIG. 10 is a detailed sectional view taken substantially on the line 10—10 of FIG. 6 illustrating the engine idling fuel adjusting valve.

A valve means for regulating fuel for the secondary or supplemental fuel delivery or discharge system for engine idling and low speed operation is illustrated in FIG. 10. The body member or component 14 is fashioned with a bore 132 having a threaded region accommodating the threaded portion of an adjustable valve member or restrictor 134. The valve member 134 has a tenon portion 135 terminating in a needle valve portion 136 extending into and cooperating with a restricted passage 137 which opens into a chamber or bore 138 in the body member 14. A coil spring 139 is associated with the valve body 134 providing friction for holding the valve body and needle valve portion 136 in adjusted position.

The carburetor body member 14 is fashioned with a passage 142 which opens into a chamber or passage 144, shown in FIGS. 6 and 7, the passage 144 being in registration with a perforate region or opening 146 in the gasket 18 and with a similar perforate region or opening 147 in the plate or laminate 16. The bore 120 in the main orifice fitting 34 is in communication with the opening or passage 147 in the laminate or plate 16.

The flow path of the fuel for delivery through the main orifice or aperture means 112 from the chamber 74 is as follows: The fuel is aspirated into the mixing passage and flows from the diaphragm fuel chamber 74 through the passage 129, past the restrictor or needle valve 127 through passage 128, bore 122, passage 142, chamber 144, opening 146 in the gasket 18, opening 147 in the plate or laminate 16, through the bore or passage 120 in the fitting 34 past the check valve means or ball valve 116 and is delivered into the mixing passage from the main orifice or aperture means 112.

The fuel flow and delivery system is inclusive of an arrangement for delivering fuel from a channel into the mixing passage through engine idling and low speed orifices or aperture means and delivering fuel from the channel into the mixing passage for engine accelerating purposes through an orifice or aperture means independent of the fuel delivery orifices or aperture means for engine idling and low speed purposes and the aperture means or orifice for high speed operation.

Figure 11:
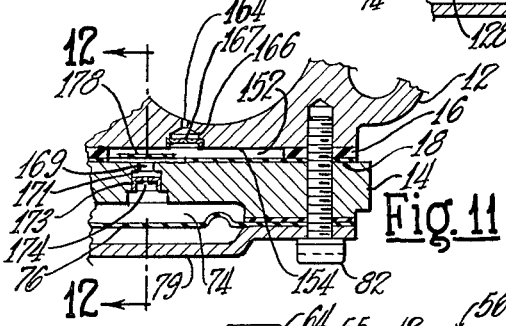
FIG. 11 is a detailed sectional view taken substantially on the line 11—11 of FIG. 6.
Figure 1:
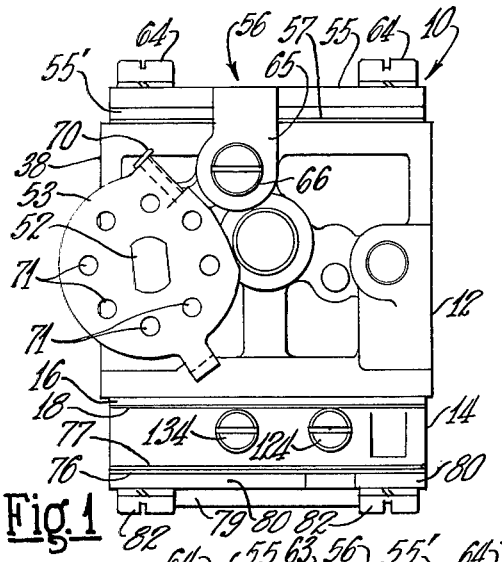
FIG. 1 is a side elevational view of a charge forming apparatus or carburetor and fuel pump construction embodying the invention.

As shown in FIGS. 6 and 8, the body member 12 is fashioned with a chamber 148 which is in communication with the mixing passage 20 by way of an engine idling orifice or aperture means 149 and low speed orifices or aperture means 150 and 151. With particular reference to FIGS. 6, 11 and 16, the plate or laminate 16 is fashioned with a generally U-shaped perforate region or channel 152, the adjacent surface 154 of the carburetor body component or member 12 and the adjacent surface of the gasket 18 defining the opposite walls of the channel 152.

The channel 152 is adapted at engine idling and low speeds to convey fuel into the mixing passage through engine idling and low speed aperture means. The channel 152, in association with valve means, is scavenged of fuel which is delivered into the mixing passage through an independent aperture means for engine accelerating purposes when the throttle valve 50 is moved to full open position. One end 156 of the fuel channel 152 is in registration with a fuel passage 158, shown in FIG. 10, whereby fuel may flow from the channel 152 through the fuel passage 158 into the bore 132, thence past the adjustable needle valve 136 into passage 138 through open area 161 thence into a substantially rectangular perforate region or open area 160 into the chamber 148.

The generally rectangular opening or perforation 160 in the laminate 16 is in communication with an arcuately-shaped perforation or open area 161, shown in FIGS. 6 and 16, which is in registration with the passage 138 in the body member 14, as shown in FIG. 10. The gasket 18 has a generally rectangular opening 160' which registers with the open area or perforation 160 when in assembled relation.

Referring to FIGS. 6 and 11, the main carburetor body or member 12 is fashioned with an aperture means or fuel delivery orifice 164 which is independent of the main fuel delivery aperture means and the engine idling and low speed aperture means. The aperture means or orifice 164 is in registration with a counterbore 166. A capillary seal screen 167 is disposed in the counterbore for a purpose hereinafter explained.

The channel 152 receives fuel from the fuel chamber 74 through an arrangement particularly illustrated in FIGS. 11 and 18. The body member 14 is provided with a bore or fuel port 169 opening into a counterbore 171. Pressed or otherwise secured in the counterbore 171 is a cup-like fitting 173 which is provided with a fuel metering orifice or restrictor 174. The fuel metering orifice or restrictor 174 admits fuel from the chamber 74, the fuel flowing through the port 169 into the channel 152 under engine idling and low speed conditions.

A valve means or check valve construction is associated with the fuel port 169 for preventing reverse flow of fuel from the channel 152 through the port 169 into the fuel chamber 74. One form of valve means is illustrated in FIGS. 6, 11, 12, 17 and 18. The gasket or laminate 18 is provided with a generally semiannularly shaped blanked out or open region 176 which forms or defines a flap valve or flap valve portion 178 which is integral with the gasket 18, the valve or valve portion 178 being adapted to be flexed at its integral connection with the gasket. The laminate 18 has an open area 156' which, in assembly with the laminate 16, is in registration with the end region 156 of the channel 152.

Figure 12:
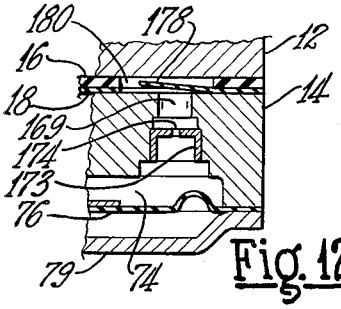
FIG. 12 is a fragmentary sectional view taken substantially on the line 12—12 of FIG. 11.

Referring particularly to FIG. 16, the fuel channel 152 at one end is fashioned with a generally semicircular perforate region or enlarged area 180 of a dimension to accommodate flexing movements of the valve 178 and to facilitate flow of fuel from port 169 into portion 180 of the fuel channel 152 past the flap valve 178 when the latter is in open position, as shown in FIG. 12.

The arrangement or system for delivering fuel from the fuel chamber for engine idling and low speed operation functions in the following manner: With the throttle valve 50 in near closed or engine idling position, as shown in FIG. 8, exposing the engine idling orifice or aperture means 149 to the downstream or engine side of the throttle valve, or if the throttle is partially opened exposing one or both low speed orifices 150 and 151 to the downstream side of the throttle valve, engine aspiration or reduced pressure is effective on the engine idling or low speed orifices or apertures to aspirate fuel into the mixing passage.

The engine aspiration causes fuel from the chamber 74 to flow through the metering restriction or restrictor 174 in the fitting 173, shown in FIGS. 11 and 12, through the port 169 past the flap valve 178 through the generally U-shaped channel 152 to the end region 156 of the channel thence through the passage 158, shown in FIG. 10, into the bore 132 past the engine idling adjusting needle valve 136 through the passage or chamber 138 into the rectangular perforate region 160 of the laminate or plate 16 and chamber 148 provided in the body member 12 and through one or more of the apertures or orifices 149, 150 and 151 depending upon the relative position of the throttle valve 50.

The capillary seal screen 167 adjacent the orifice or aperture means 164, shown in FIGS. 11 and 18, is wetted with liquid fuel and, being a fine mesh screen, the fuel in the screen forms a capillary seal to prevent air back bleeding from the mixing passage 20 through the orifice or aperture means 164 into the fuel channel 152 during engine idling or low speed operation.

The arrangement is inclusive of a method and means for utilizing fuel contained in the channel 152 for accelerating the engine when the throttle is opened from engine idling position and also utilizing the channel for delaying delivery of fuel upon sudden closing of the throttle valve to prevent a surge of fuel for engine idling which may cause the engine to stall. In such arrangement, pressure pulses of gases from the engine crankcase are utilized to scavenge or rapidly force the fuel in the channel 152 through the orifice or aperture means 164 into the mixing passage 20 for accelerating the engine, the fuel delivery aperture means 164 being independent of the main fuel delivery orifice or aperture means and the engine idling and low speed orifices or aperture means.

Figure 15:
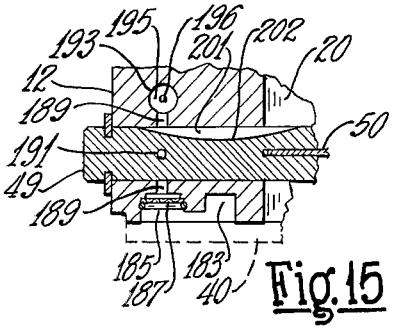
FIG. 15 is a detailed sectional view taken substantially on the line 15—15 of FIG. 14.
Figure 14:
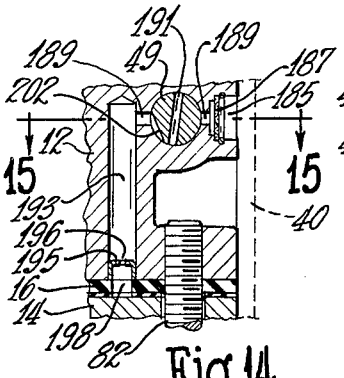
FIG. 14 is a detailed sectional view taken substantially on the line 14—14 of FIG. 13.
Figure 13:
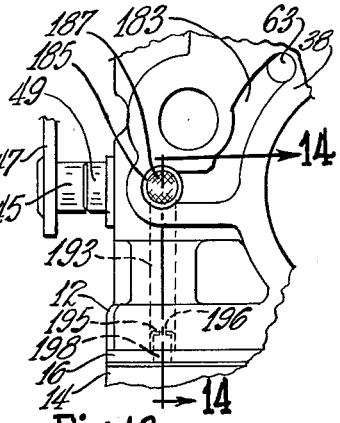
FIG. 13 is a fragmentary view of a portion of a carburetor illustrating a pulse pressure channel system for effecting delivery of fuel for engine acceleration purposes.

The establishing of crankcase pulse pressure on the fuel in the channel 152 is controlled through valve means associated with the throttle mechanism, the arrangement being illustrated in FIGS. 13 through 15 and in the schematic view, FIG. 18. The mounting face or surface 38 of the carburetor body 12 is provided with a pulse passage or channel 183 which is in communication with a recess 185 formed in the body 12.

Disposed in the recess 185 is a filter screen 187, which is preferably of fine mesh metal screening, to prevent passage of sludge or crankcase contaminates into the pulse channel system. The recess 185 is in communication with a passage means 189 in the body 12, the throttle shaft 49 having a transverse passage 191 which, upon rotation of the throttle shaft 49, is adapted to be moved into or out of registration with the passage means 189. The passage means 189 is in communication with a bore or passage 193 in the body 12.

Fixedly disposed in the passage 193 is a cup-like member or metering fitting 195 provided with a restricted opening or passage 196 for metering gas flow from the engine crankcase. The gases from the crankcase may be air or a mixture of fuel vapor and air. The end region of the passage 193 containing the fitting 195 is in registration with an end region 198 of a perforate region or channel 199 provided in the laminate or plate 16 as shown in FIG. 16. The perforation or channel 199 is in communication with the rectangularly-shaped open area or perforate region 160 in the plate 16, as shown in FIGS. 6 and 16.

When the throttle is moved to full open position, the valve passage 191 in the throttle shaft 49 is in registration with the passage means 189, shown in FIGS. 14 and 15, whereby pressure pulses from the crankcase of the two-cycle engine with which the carburetor is used are transmitted through the passage 193 into the perforate region or channel 199 and into the rectangularly-shaped perforate region or chamber 160 to effect delivery of fuel in the channel 152 into the mixing passage as hereinafter described.

Means is provided for relieving pressure in the channel 199 and the perforate region or chamber 160 when the throttle valve 50 is in engine idling position shown in FIG. 8. As shown in FIGS. 14 and 15, the throttle shaft 49 is fashioned with a cutaway portion providing a vent passage 201 defined by a contour 202 in the throttle shaft.

As will be seen from FIG. 15, when the throttle valve 50 is in near closed or engine idling position, one end region of the vent space or passage 201 is in registration with the adjacent passage means 189 and the passage 193, the other end region of the vent space or passage 201 opening into the mixing passage 20 whereby pulse pressure in chamber 160, channel 199 and passage 193 will be relieved through the vent provided by the space 201.

FIG. 18 illustrates schematically the perforate regions in the laminate or plate 16 for conveying fuel to the main fuel delivery aperture means or orifice, the engine idling and low speed aperture means or orifices, the aperture means independent of the other aperture means for delivering fuel into the mixing passage for engine accelerating purposes, and the pulse pressure conveying passages for ejecting fuel through the engine accelerating aperture means.

The operation of the carburetor with the engine running and the throttle in engine idling position, as shown in FIGS. 8 and 15, is as follows: Fuel is aspirated into the mixing passage through the engine idling orifice or aperture means 149 at the downstream side of the throttle valve as shown in FIG. 8. The engine aspiration is communicated through the channel system to the fuel chamber 74 setting up reduced pressure in the fuel chamber 74 causing a flexing of the metering diaphragm 76 upwardly, as viewed in FIG. 7, swinging the lever 102 in a counterclockwise direction to move the inlet valve 99 away from the port 98 to valve in fuel into the fuel chamber 74.

The fuel in the chamber 90 is under comparatively low pressure of from about 3 to 7 pounds per square inch from the fuel pump construction 56. The engine aspiration is effective through the engine idling orifice 149, supplemental chamber 148, the perforate rectangular region 160 and perforate region 161 in the laminate or plate 16, and, as shown in FIG. 10, through bore 138, passage 137, past the needle valve 136, bore 132, bore 158, region 156 of channel 152, through channel 152, to the enlargement 180 at the other end of the channel 152, past the flap valve 178 which is opened by the aspiration, through the metering restriction 174 in the fitting 173 to the fuel chamber 74.

Thus, the aspiration effective upon the above described engine idling fuel delivery system establishes fuel flow from the fuel chamber 74 through the metering restriction 174 in the cup-like member 173 and into the channel 152 filling the channel with fuel, the rate of delivery of fuel through the engine idling orifice 149 being regulated by the needle portion 136 of the adjustable valve 134. The fuel metering restriction 174 in the member 173 is of a size to admit the passage of sufficient fuel to satisfy the engine requirements for idling and low speed operation and control the "come down" by metering fuel flow from the fuel chamber into the elongated channel 152.

The aspiration through the engine idling aperture means or orifice 149 fills the channel 152 with liquid fuel. The capillary seal screen 167, wetted with liquid fuel, prevents back bleeding of air from the mixing passage through the fuel discharge aperture means 164 into the channel 152 during the delivery of fuel through the engine idling aperture means 149.

During the functioning of the engine idling fuel delivery system, the transverse passage 191 in the throttle shaft 49, shown in FIGS. 14 and 15, is out of registry with the passage means 189 so that there is no crankcase pulse pressure transmitted into the passage 193, channel 199 or the perforate region 160 in the laminate or plate 16. As shown in FIG. 15, the space or passage 201 vents the passage 193 to the mixing passage 20 during engine idling.

The operation of the fuel delivery system of the carburetor when the throttle valve 50 is quickly moved to open position is as follows: The circuitous channel or perforate region 152 in the laminate or plate 16 is already filled with liquid fuel. As the throttle valve is moved toward open position, the initial aspiration in the mixing passage is of comparatively low amplitude and until the engine speed increases and the amplitude of aspiration in the mixing passage is increased, the rate of delivery of fuel through the main aperture means or orifice 112 is comparatively low.

Thus, normally the establishment of a high power mixture is delayed until reduced pressure is developed in the mixing passage sufficient to aspirate fuel from the main orifice in an amount to provide a proper fuel and air mixture.

In the arrangement herein described, as the throttle valve 50 is opened, fuel flows from the fuel chamber 74 into the bore or passage 129 in the body component 14 thence through the restricted passage 128 past the adjustable needle valve 127 through the passage 142, shown in FIGS. 6, 9 and 18, into the passage 144, shown in FIGS. 6 and 7, through the perforate region 147 in the plate 16, through the bore 120 in the fitting 34 past the check valve 116, the fuel being then discharged through the main aperture means or orifice 112 into the mixing passage at the choke band region 28 of the Venturi 27.

Concomitantly with the opening of the throttle valve 50, fuel for accelerating the engine is provided as follows: The throttle shaft 49 is rotated to a position wherein the channel or passage 191 in the throttle shaft is in registration with the passage means 189, the gases in the crankcase, being under pressure, flow through the channel 183 through the filter screen 187 and to the passage or bore 193. The gases flow through the restricted passage 196, shown in FIG. 14, into the end region 198 of the channel 199 shown in FIG. 6.

The gases flow through the chamber or perforation 160 and the open area 161, shown in FIGS. 6 and 10, through the passage 138 and the restricted passage 137, past the adjustable needle valve 136. The bore 132, containing the tenon 135 of the engine idling adjusting valve body 134, the passage 158 and the circuitous channel 152 are already filled with fuel.

The pressure of the crankcase gases is effective to force the fuel in the channel 152 in a direction opposite to its direction of flow for engine idling purposes, the fuel being projected or injected through the screen 167 and aperture means 164 into the mixing passage 20 providing adequate fuel to effect rapid acceleration of the engine to a high speed.

The gas pressure on the fuel in the channel 152 exerts pressure on the flap valve 178 closing the port 169 so that fuel in the channel 152 is not returned to the fuel chamber 74 but is positively injected through the aperture means or engine accelerating orifice 164 into the mixing passage 20.

Thus, the engine is rapidly accelerated in speed as it is supplied with fuel not only through the main aperture means or orifice 122 but also through the engine accelerating aperture means or orifice 164 so that a rich power mixture is conveyed to the engine. When crankcase pressure is effective in the channel 199, some of the crankcase air or gas is discharged through the engine idling and low speed aperture means into the mixing passage 20. However, there is sufficient high pulse pressure at the passage 137, shown in FIG. 10, to force the crankcase air or gas past the needle valve 136 and force or scavenge the fuel in the channel 152 through the orifice or aperture means 164 for engine acceleration purposes.

The fuel in the channel 152 is thus rapidly injected through the aperture means or orifice 164 into the mixing passage 20 for accelerating the engine. During normal or high speed operation of the engine after the fuel in the channel 152 has been injected into the mixing passage, the engine operates on fuel delivered from the main aperture means or orifice 112 and, during such operation, crankcase gases in a limited amount as permitted by the metering restriction 196 in the fitting 195, shown in FIG. 14, continue to be discharged through the engine idling and low speed aperture means and through the engine accelerating aperture means or orifice 164 into the mixing passage.

Such continued discharge of air or gas from the engine crankcase through the system does not appreciably modify the fuel and air mixture supplied for normal and high speed engine operation.

When the throttle valve 50 is returned to engine idling position, engine aspiration then becomes effective through the engine idling aperture means or orifice 149 and the engine idling and low speed channel system to open the flap valve 178 and fuel aspirated from the chamber 74 through the restriction 174 to replenish or fill the channel 152 with fuel. As the channel 152 must be filled with fuel before fuel is delivered into the mixing passage through the engine idling orifice 149, a time delay occurs before fuel is delivered from the engine idling orifice 149.

This delay is referred to as a slow build-up so that the engine will use up excess fuel that accumulates in the engine crankcase during open throttle operation. If the engine idling system discharges fuel too quickly through the engine idling orifice 149 upon closing the throttle valve 50, this fuel is superimposed on a flash vaporization of the residual or accumulated fuel in the engine crankcase, a condition which often results in stalling of the engine. The larger the channel 152, the greater the time delay as it requires a longer time for the channel 152 to fill with fuel. The smaller the channel 152, the less the time delay in which fuel is supplied to the engine idling orifice 149.

Thus, the time delay in the delivery of fuel through the engine idling orifice 149 after the closing of the throttle valve 50 may be regulated or controlled by varying the length or width of the channel 152 or the thickness of the laminate or plate 16, or the size of the flow passage or metering restriction 174. As the plate 16 is formed by shearing or blanking dies, the metering characteristics of the carburetor may be quickly changed by substituting one plate 16 having one pattern of perforations for a plate of the same size having a different pattern of perforations.

It should be noted that the fluid flow channels or passages are contained within the laminate or plate 16 so that the metering characteristics of the carburetor may be modified through the use of laminates or plates 16 having various fluid flow perforate regions without modifying the carburetor body components.

The carburetor body construction is configurated so that it may be equipped with an overspeed governor of the character disclosed in U.S. Pat. No. 3,738,608. With reference to FIGS. 6 and 7, the body component or member 14 is provided with a fuel passage 205 which is in registration with a perforate region or opening 207 in the plate 16, also shown in FIG. 16.

Figure 17:
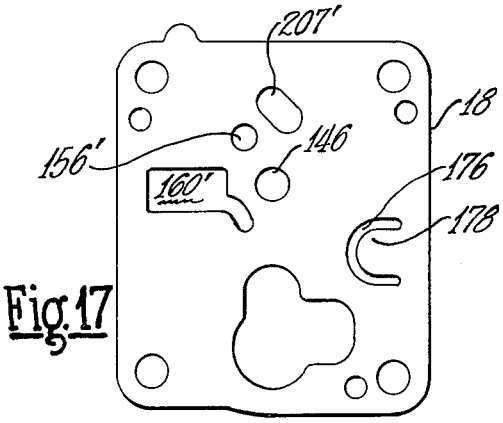
FIG. 17 is a plan view of a flexible laminate or member provided with a fluid flow control valve means.

The perforate region or open area 207 in the plate 16 registers with an opening 207' in the flexible member 18, shown in FIG. 17, when the gasket 18 and the laminate or plate 16 are in assembled relation. The open area 207 is normally blocked by a lower surface portion 208 of the carburetor body 12 as shown in FIG. 7. A cylindrical recess 210 is cored in the body 12 which is adapted to be machined or threaded to accommodate an overspeed governor construction.

Where the carburetor body 12 is equipped with a governor construction, a passage is drilled in the body connecting the perforate region 207 in the plate or laminate 16 with the recess 210 and a passage drilled from the bottom of the recess 210 into the mixing passage to convey excess fuel into the mixing passage when the engine attains a predetermined speed, the excess fuel providing an overrich slow burning mixture for reducing or governing the speed of the engine as described in U.S. Pat. No. 3,738,608.

Through the utilization of the laminate or plate 16, the fuel conveying channels or passages are contained within the laminate, and by interchanging laminates having different patterns of perforate regions, the metering characteristics of the carburetor may be varied utilizing the same body components 12 and 14 and thus reduce the cost of producing the carburetor.

Figure 19:
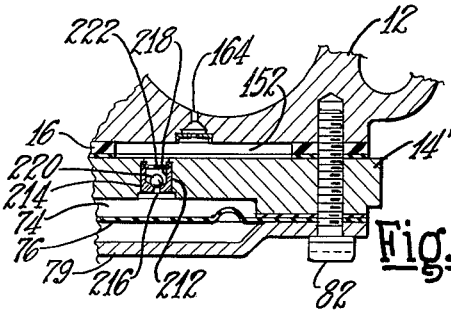
FIG. 19 is a view similar to FIG. 11 illustrating another form of valve means controlling fuel flow in an engine idling fuel system.

FIG. 19 illustrates another form of check valve means that may be used in lieu of the flap valve 178, shown in FIG. 12, for preventing return flow of fuel from the channel 152 into the fuel chamber 74 when the fuel in the channel 152 is being injected into the mixing passage through the engine accelerating aperture means 164. As shown in FIG. 19, the body component 14' is provided with a bore 212 in which is pressed a fitting 214 having a restricted opening or restriction 216 which corresponds with the restricted opening 174 shown in FIG. 12. The fitting 214 has a counterbore 218 in which is loosely disposed a valve member or ball valve 220. A narrow bar 222 extends across the upper end of the fitting 214 to prevent dislodgment of the ball valve 220.

During engine idling operation, fuel flows from the fuel chamber 74 through the metering passage or restriction 216, past the ball valve 220 into the channel 152, the fuel from the channel 152 being delivered through the engine idling orifice 149 into the mixing passage. When the fuel in the channel 152 flows in a reverse direction for delivery through the engine accelerating aperture means or orifice 164, the ball valve 220 prevents the return of fuel from the channel 152 to the fuel chamber 74. Where the check valve construction shown in FIG. 19 is utilized, it is unnecessary to employ the gasket or laminate 18.

It is apparent that, within the scope of the invention, modifications and different arrangements may be made other than as herein disclosed, and the present disclosure is illustrative merely, the invention comprehending all variations thereof.

I claim:

1. Charge forming apparatus for use with a two cycle internal combustion engine including a body construction provided with a fuel and air mixing passage and a fuel chamber, a fuel inlet valve, means for controlling the inlet valve, a throttle valve in the mixing passage, the mixing passage having an air induction zone and a fuel dispersion zone, the fuel dispersion zone including main aperture means for delivering fuel into the mixing passage, an engine idling aperture means for delivering fuel into the mixing passage, a supplemental chamber in said body construction in communication with the engine idling aperture means, additional aperture means independent of the main aperture means and engine idling aperture means for delivering fuel into the mixing passage, laminar means associated with the body construction having perforate regions, one of said perforate regions providing an elongated fluid flow channel, said elongated channel being in communication with the supplemental chamber, a port in said body construction establishing communication between the fuel chamber and the elongated channel accommodating flow of fuel from the fuel chamber into the elongated channel, said additional aperture means being in communication with said elongated channel, a a pulse pressure passage means establishing communication between the crankcase of the engine and the supplemental chamber, valve means associated with said throttle valve operable when the throttle valve is moved to open position for establishing pulse pressure in said elongated channel for projecting fuel through the additional aperture means into the mixing passage, and check valve means associated with said port for preventing reverse flow of fuel from the elongated channel into the fuel chamber.

2. Charge forming apparatus for use with a two-cycle internal combustion engine including a body construction comprising first and second members, the first member having a fuel and air mixing passage, a movable throttle valve in said mixing passage, the second member having a fuel chamber, a fuel inlet valve for the fuel chamber, means responsive to engine aspiration for controlling flow of fuel from a supply into the chamber, said first member having an air induction zone and fuel dispersion zones, said fuel dispersion zones including an engine idling fuel delivery aperture means and a high speed fuel delivery aperture means and an engine accelerating fuel delivery aperture means, fluid flow control laminar means associated with said body members, a fluid flow channel in said laminar means for establishing communication between said engine idling aperture means and said engine accelerating aperture means, a fuel passage between said fuel chamber and said fluid flow channel, check valve means associated with said fuel passage adapted in open position to admit fuel from the chamber to said fluid flow channel for engine idling, a pulse passage means for establishing communication between the engine crankcase and the engine idling aperture means, and valve means for said pulse passage means associated with said throttle valve to open the pulse passage means when said throttle valve is moved to open position whereby pulse pressure moves the fuel in said fluid flow channel through the engine accelerating fuel delivery aperture means into the mixing passage.

3. Charge forming apparatus including a body construction comprising first and second body members, the first member having a fuel and air mixing passage, a movable throttle valve in said mixing passage, the second member having a fuel chamber, a fuel inlet valve for the fuel chamber, a diaphragm forming a wall of the fuel chamber responsive to engine aspiration for controlling the fuel inlet valve to regulate flow of fuel from a supply into the fuel chamber, said first member having an air induction zone and fuel dispersion zones, said fuel dispersion zones including an engine idling fuel delivery aperture means and a high speed fuel delivery aperture means, fluid flow control laminar means disposed between said body members, an elongated fluid flow channel in said laminar means, a first bore in said second body member in communication with the high speed fuel delivery aperture means, a first passage between said fuel chamber and said first bore, a first adjustable valve means in said first bore for regulating fuel flow from the fuel chamber to the high speed fuel delivery aperture means, a supplemental chamber in said first body member in communication with the engine idling fuel delivery aperture means, a second bore in said second body member, fuel passage means establishing communication between one end region of the elongated fuel flow channel and the second bore in said second body member, a fuel passage between said second bore and said supplemental chamber, second adjustable valve means in said second bore for regulating fuel flow to said supplemental chamber, a fuel port in said second body member establishing communication between the fuel chamber and the other end region of the elongated fuel flow channel, and check valve means associated with said port adapted in open position to admit fuel flow from the chamber to the elongated channel and in closed position preventing reverse flow of fuel from the elongated channel into the fuel chamber.

4. Charge forming apparatus for use with an internal combustion engine including a body construction provided with a fuel and air mixing passage and a fuel chamber, a fuel inlet valve, means for controlling the inlet valve, a throttle valve in the mixing passage, the mixing passage having an air induction zone and a fuel dispersion zone, the fuel dispersion zone including main aperture means for delivering fuel into the mixing passage, an engine idling aperture means for delivering fuel into the mixing passage, additional aperture means independent of the main aperture means and engine idling aperture means for delivering fuel into the mixing passage, a laminar means associated with the body construction having perforate regions providing fluid conveying channels, the perforate regions arranged to receive fuel from the fuel chamber, one of said perforate regions being an elongated channel adapted to convey fuel to the said additional aperture means for delivery into the mixing passage for engine acceleration, a passage in the body construction in communication with the fuel chamber and the elongated channel for admitting fuel into the elongated channel under the influence of engine aspiration at the engine idling aperture means for delivery through the engine idling aperture means, and check valve means associated with the said passage establishing communication between the fuel chamber and the elongated channel for preventing reverse flow of fuel from the elongated channel into the fuel chamber.

5. Charge forming apparatus according to claim 4 including means associated with the additional aperture means to prevent back bleeding of air from the mixing passage into the elongated fuel channel when the latter is conveying fuel for discharge through the engine idling aperture means.

6. Charge forming apparatus according to claim 5 wherein the means to prevent back bleeding of air through the additional aperture means comprises a capillary seal screen.

7. Charge forming apparatus according to claim 4 including a gasket member disposed contiguous with the laminar means, the check valve means comprising a flexible flap valve integral with the gasket member, said flap valve adapted to close the passage establishing communication between the fuel chamber and the elongated channel when fuel is being delivered from the elongated channel through the additional aperture means.

8. Charge forming apparatus according to claim 4 including a restrictor associated with the passage for conveying fuel from the fuel chamber into the elongated channel for metering the flow of fuel into the elongated channel.

9. Charge forming apparatus according to claim 4 including a fitting disposed in the passage establishing communication between the fuel chamber and the elongated channel, and a ball check valve in said fitting facilitating flow of fuel from the fuel chamber to the elongated channel but preventing reverse flow of fuel from the elongated channel into the fuel chamber, said fitting having a restriction for metering the flow of fuel from the fuel chamber into the elongated channel.

* * * * *